United States Patent [19]

Thesenfitz

[11] Patent Number: 4,585,354

[45] Date of Patent: Apr. 29, 1986

[54] DEVICE FOR PREPARING ROADWAY PAVING MATERIALS

[75] Inventor: Klaus Thesenfitz, Winsen, Fed. Rep. of Germany

[73] Assignee: Linhoff & Thesenfitz, Winsen, Fed. Rep. of Germany

[21] Appl. No.: 618,097

[22] Filed: Jun. 7, 1984

[30] Foreign Application Priority Data

Jun. 8, 1983 [DE] Fed. Rep. of Germany ..... 3320682

[51] Int. Cl.[4] ..... B28C 5/46

[52] U.S. Cl. ..... 366/25; 209/238; 209/290

[58] Field of Search ..... 366/25, 24, 22, 23, 366/7, 144, 147; 209/11, 238, 284, 290, 288, 2; 34/128, 129, 135, 142; 432/103

[56] References Cited

U.S. PATENT DOCUMENTS

| | | | |
|---|---|---|---|
| 1,250,554 | 12/1917 | Bryan | 209/290 |
| 3,942,644 | 3/1976 | Vissers | 209/238 |
| 4,174,181 | 11/1979 | Garbelman | 366/25 |
| 4,215,941 | 8/1980 | Mendenhall | 366/25 |
| 4,318,619 | 3/1982 | Schlarmann | 366/25 |
| 4,332,478 | 6/1982 | Hamshire | 366/25 |

*Primary Examiner*—Robert W. Jenkins

*Attorney, Agent, or Firm*—Alan H. Levine

[57] ABSTRACT

An elongated drum rotatable about its horizontal longitudinal axis is surrounded by a sequence of cylindrical screens having different size mesh openings. A burner is located at one end of the drum. A feeder delivers stone chips into the end of the drum opposite the burner, and another feeder delivers used paving asphalt into the end of the drum at which the burner is located. The asphalt feeder has an elbow which passes through the burner flame and an outlet located outside the flame. Openings at the burner end of the drum provide communication between the interior of the drum and an annular space between the drum and the screens. A chimney for discharging dust is located at the stone chips feeder end of the drum.

5 Claims, 1 Drawing Figure

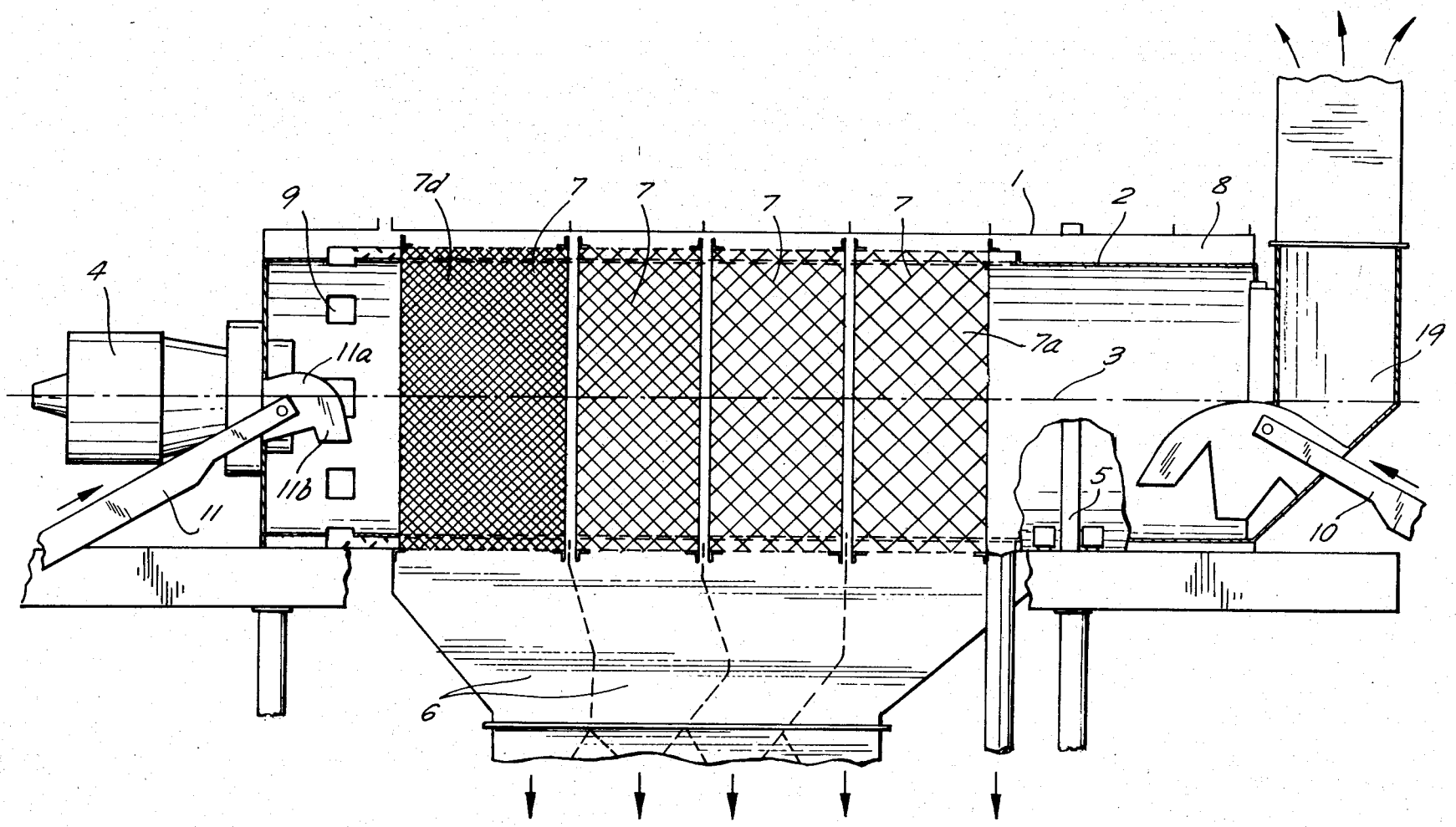
19
10
8
2
3
5
1
7a
7
7
7
7
7d
6
11a
11b
9
11
4

DEVICE FOR PREPARING ROADWAY PAVING MATERIALS

In the paving of roadways with bitumen, the roadway paving material essentially comprises bitumen, or asphalt, and stone chips of different sizes. The function of stone chips of coarser size is to build up a supporting framework, and that of stone chips of smaller size is to fill up, within limits, the hollow spaces within the supporting framework. The bitumen or asphalt, which penetrates into the stone chips so prepared, joins the stone chip components together and fixes them in position.

In the preparation of roadway paving material, care must be taken to ensure that the individual components of the roadway paving material are used in the correct mixing ratio. This is particularly important when the individual components are not applied in sequence to the surface to be paved. In a sequential application, the supporting framework is built up first from coarse stone chips, then the stone chips of smaller size are spread to penetrate into the hollow spaces of the supporting framework, and finally the bitumen or asphalt is applied. However, when the road paving mixture is first prepared separately and then applied as a whole on to the road bed, use of a correct ratio of the components of the mixture is important. The latter method is used to provide as efficient a procedure as possible. In this case, the individual components are combined in mixers and mixed well, then brought to the processing temperature, and then applied on to the road bed to be paved.

With such a known process, stone chips of different particle size are fed in the correct mixing ratio from each of a number of charging hoppers, corresponding to the number of different particle sizes of stone chips, to a conveyor belt and introduced into a horizontal drum, which is rotating about its longitudinal axis. The stone chips are introduced at one end of the drum and conveyed, as the drum is rotating, to the other end of the drum. A burner protrudes into the drum from this other end of the drum. The direction of the flame is opposite to the direction of transport of the stone chips, which are heated by the flame to about 200° C. Dust and moisture are removed while the stone chips are being transported through the drum, so that the stone chips, leaving the end of the drum, are dried, preheated, and freed from dust.

The stone chips, leaving the drum in such a prepared state and in the desired particle size composition, are added by means of a scoop to a screening device with a scale, in which an appropriate amount of the previously removed dust is returned to the stone chips and, in addition, bitumen and a predetermined amount of filler are added. In order to have the desired processing temperature, bitumen is added at a temperature of 165° C. to stone chips at a temperature of 10° C. The mixture, the proper proportions of which are ensured by the scale, is finally mixed well in a 2-shaft positive mixer and is then available for application to the road bed.

A road-paving mixture of good quality is achieved with this generally used process and road paving can be accomplished which satisfies all requirements. The process has, however, the disadvantage of relatively high cost. The installation, required for carrying out the process, is very expensive to construct and to operate. Moreover, no provisions are made in this process for, nor is it possible to, reuse old street paving, that is, to introduce old street paving in an appropriate proportion into the production process of the new street paving.

In an endeavor to achieve a useful result with little expenditure for construction or operation, the known installation was changed. Accordingly, the drum is surrounded concentrically by a cylindrical screen with mesh sizes which differ in consecutive sections of the screen in the longitudinal direction of the drum. After the stone chips of different size emerge from the delivery end of the inner drum, the stone chips reach the annular gap between the outer wall of the drum, which is closed except for outlet openings, and the cylindrical screen. The cylindrical screen in turn is surrounded by a housing, which has a delivery funnel at its lower end. The stone chips are screened by the cylindrical screen and pass through the delivery funnel for further processing, which takes place in the installation previously described. A useful result is also achieved with this installation and the expenditure for construction and operation is reduced. However, with this installation also, it is not possible to reuse old street paving.

It is an object of the present invention to improve both versions of the known installation in such a way that expenditures for construction and operation are reduced further, and particularly to make it possible to reuse old street paving.

The invention will now be described in greater detail with reference to the accompanying drawing, which schematically shows a mixing drum according to the invention capable of using old street paving material.

A drum 2, with a horizontal longitudinal axis 3, is mounted on bearings in a stationary housing 1 in such a manner that it can rotate about this longitudinal axis. From the end of the drum 2, shown on the left in the drawing, a burner 4 projects into the drum, the longitudinal axis of the burner flame coinciding with the longitudinal axis 3 of the drum. In principle, the burner can be of any type and be operated with gas or oil. Drum 2 is driven by a motor, not shown, through a transmission which includes a barrel ring 5 that surrounds the drum and is rigidly connected to it. At the lower end of the drum, several so-called hot silos 6 are arranged consecutively on housing 1 in the longitudinal direction of the drum. These hot silos are funnel-shaped containers, which are well insulated against loss of heat by radiation, and which contain the stone chips of different particle size that emerge from drum 1, and are mixed with bitumen or asphalt in a manner still to be described, the hot silos delivering these chips to a conveyor belt for further processing.

In order to be able to screen the material, cylindrical screens 7 are arranged consecutively on drum 2 in the longitudinal direction of the drum. There is an annular space 8 between the outer wall of drum 2 and the cylindrical screens 7. The cylindrical screens have different mesh sizes, cylindrical screen **7*a* with the largest mesh openings being at the right end (in the drawing) of drum 2 and cylindrical screen 7*d* with the smallest mesh openings at the left end. Annular space 8 communicates with the interior of drum 2 by way of openings 9**, which are distributed uniformly over the circumference of the drum at the left end (in the drawing) of the drum.

While the installation is in operation, different material is fed into drum 2 by feeding devices 10 and 11 at each end of the drum. New material in a cold condition, especially stone chips of different particle size, are fed into the drum by device 10 at the right end of the drum away from burner 4. This material migrates towards burner 4, and in so doing, is heated to the desired temperature. Asphalt is fed into the drum by device 11 at the burner end of the drum. Device 11 is so designed and arranged that the asphalt, although it is heated to the desired temperature, does not burst into flame and burn. For this reason, feeder elbow 11*a* passes through the flame zone of burner 4, but its outlet 11*b* is below the flame zone and pointing downwards. Mixing between the old asphalt, introduced by way of device 11, and new material, introduced by way of device 10, takes place in the region of the delivery opening 9. Since the asphalt is not heated as much directly by burner 4 as indirectly, while passing through elbow 11*a* in the flame zone and by absorbing heat from the fresh material, ignition of the asphalt is largely prevented.

The asphalt is in the mixing drum for a relatively short time, is heated without direct contact with the flame and, while being heated, is mixed well with the heated stone chips, which come from the other end of the drum. The mixture of asphalt and stone chips passes through openings 9 into annular space 8, and from there screened according to stone chip size into the hot silos, from which it can be removed for further processing. Dust and moisture are discharged through a waste gas chimney 19 at the same end of the drum as feeding device 10.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A device for preparing roadway paving materials, comprising:

(a) an elongated drum having a horizontal longitudinal axis and rotatable about that axis, (b) cylindrical screens surrounding the drum, the screens being arranged along the length of the drum, and successive screens having different sizes of mesh openings, (c) a burner located at one end of the drum and adapted to direct a flame into the drum, (d) means for feeding stone chips of different size into the end of the drum opposite the end at which the burner is located, and (d) means for feeding used street paving asphalt material into the end of the drum at which the burner is located, (f) the stone chips and asphalt being mixed within the drum.

2. A device as defined in claim 1 wherein the asphalt feeding means has an outlet opening, through which the asphalt is delivered into the drum, located outside the flame created by the burner.

3. A device as defined in claim 2 wherein the asphalt feeding means includes an elbow through which the asphalt travels to the outlet opening, the elbow passing through the burner flame.

4. A device as defined in any of claims 1 to 3 wherein there is an annular space between the screens and the drum, and including openings in the drum wall in the region of the asphalt feeding means, the openings providing communication between the interior of the drum and the annular space.

5. A device as defined in any of claims 1 to 3 including a dust discharge means at the end of the drum at which the stone chips feeding means is located.

* * * * *